US005817970A

United States Patent [19]

Feierlein

[11] Patent Number: 5,817,970

[45] Date of Patent: Oct. 6, 1998

[54] PROJECTILE, ESPECIALLY FOR NONLETHAL ACTIVE COMPONENTS

[75] Inventor: Johannes Feierlein, Oberpframmern, Germany

[73] Assignee: Daimler-Benz Aerospace AG, München, Germany

[21] Appl. No.: 893,743

[22] Filed: Jul. 11, 1997

[30] Foreign Application Priority Data

Aug. 13, 1996 [DE] Germany ..... 196 32 597.8

[51] Int. Cl.[6] ..... F42B 12/00

[52] U.S. Cl. ..... 102/502; 102/334; 102/357; 102/367; 102/395; 102/498; 102/505

[58] Field of Search ..... 102/293, 334, 102/340, 342, 351, 357, 367–370, 378, 393, 395, 489, 491–498, 502, 505

[56] References Cited

U.S. PATENT DOCUMENTS

| | | | |
|---|---|---|---|
| 3,000,308 | 9/1961 | Land et al. | 102/473 |
| 3,331,324 | 7/1967 | Oss et al. | 102/378 |
| 3,528,662 | 9/1970 | Merchant et al. . | |
| 3,741,123 | 6/1973 | Dittrich | 102/491 |
| 3,815,504 | 6/1974 | Tieben | 102/494 |
| 4,328,755 | 5/1982 | Frost | 102/492 |
| 4,505,203 | 3/1985 | Brady et al. | 102/393 |
| 4,823,701 | 4/1989 | Wilhelm . | |
| 5,050,503 | 9/1991 | Menz et al. . | |

FOREIGN PATENT DOCUMENTS

| | | | |
|---|---|---|---|
| 32 28 736 A1 | 2/1984 | Germany . | |
| 87 07 244.0 | 10/1987 | Germany . | |
| 3934042 | 4/1991 | Germany | 102/489 |
| 2 032 071 | 4/1980 | United Kingdom . | |

*Primary Examiner*—Harold J. Tudor
*Attorney, Agent, or Firm*—McGlew and Tuttle

[57] ABSTRACT

A projectile, particularly for nonlethal active components. The projectile has a disintegratable shell with pyrotechnic means. The projectile has two or more shell layers made of explosive foil, each alternating with another shell layer made of supportive foil material, between a radially outer shell layer made of supportive foil material and a radially inner protective shell. The different layers made of explosive foil can be ignited sequentially when viewed radially from the outside to the inside.

20 Claims, 2 Drawing Sheets

PROJECTILE, ESPECIALLY FOR NONLETHAL ACTIVE COMPONENTS

FIELD OF THE INVENTION

The present invention pertains to a projectile especially for nonlethal active components, with a shell that can be disintegrated and pyrotechnic means for disintegrating the shell.

BACKGROUND OF THE INVENTION

Prior-art large-caliber projectiles, as they are used for military applications, usually have a massive metal shell, in which built-in parts, such as an explosive charge and an igniter, are located. When the charge is detonated, the said shell disintegrates in an uncontrolled or controlled manner. In either case, the result is fragments of a high kinetic energy, which considerably contribute to the overall action at the target.

This completely contradicts the intended purpose where targets are to be fought with nonlethal or noninjuring or nondestructive active components, such as capturing nets, rebounding bodies, blinding agents, irritants, or the like.

SUMMARY AND OBJECTS OF THE INVENTION

The primary object of the invention in question is therefore to ensure, in the case of a projectile, whose shell contains especially nonlethal active components, that the shell will disintegrate in such a way that any lethal hazard to the target is ruled out, placing a very high requirement on the reduction of the residual lethal risk, and also including, e.g., the safety of the eyes in the case of a person as the target.

According to the invention, a projectile is provided, especially for nonlethal active components, with a shell that can be disintegrated and pyrotechnic means for disintegrating the shell. Between a radially outer shell layer made of supportive foil material and a radially inner protective shell, the projectile shell has two or more shell layers made of explosive foil, each alternating with another shell layer made of supportive foil material. The different layers made of explosive foil can be ignited sequentially from the outside to the inside.

Light metal, such as aluminum, may be used as the layer-forming, supportive foil material in the projectile shell. Paper or plastic may also be used as the layer-forming, supportive foil material in the projectile shell. Also a so-called intelligent material, which has a greater hardness and lower deformability under the abrupt action of stronger mechanical forces than under normal conditions, may be used as the layer-forming, supportive foil material in the projectile shell.

The radially inner projectile shell may also consist of a supportive foil material. This radially inner protective shell may be designed for disintegration by aerodynamic forces. The radially inner protective shell may be provided with predetermined breaking points, which extend in the longitudinal direction and originate from an end of the shell that is the front end when viewed in the direction of flight.

The explosiveness may decrease in the radial direction from the outside to the inside in the shell layers made of explosive foil. A pyrotechnic arrangement for remote or interval ignition may be associated with the projectile shell for the sequential ignition of the layers consisting of explosive foil. The time intervals between the sequential igniting pulses is preferably settable.

In view of the high requirements imposed on the risk of damage due to high-energy parts of the shell flying around, no massive, fragment-forming shell is used in the projectile according to the present invention. Such a shell is replaced by a shell version that is readily able to meet conflicting requirements because of its special design. On the one hand, it definitely lends itself to robust handling, has excellent storage stability, is insensitive to the effects of moisture, and it is extremely resistant to high firing forces as they can be recorded in the case of, e.g., large-caliber barrel-type weapons with chamber pressures ranging from a few hundred to a few thousand bar and acceleration values ranging from a few thousand to a few ten thousand g. On the other hand, the layered explosive foils and the sequential ignition of same offer additional guarantee that the supportive foil material is split off piece by piece from the outside to the inside in the radial direction down to the radially inner protective shell. Thus, instead of high-energy shell fragments, only split-off pieces of foil are generated, which are instantaneously decelerated by the air resistance and therefore do not represent any hazard for the particular target of interest any more.

The following shall be additionally mentioned in connection with the radially inner protective shell: The sense and purpose of this protective shell is to protect the active components inside the projectile from the forces which occur during the splitting off of the other, supportive foil material. As soon as this protective function is no longer needed, the protective shell can be readily eliminated. This is advantageously brought about by aerodynamic forces. Predetermined breaking points, which originate from the one end of the protective shell to be eliminated, which said end is the front end when viewed in the direction of flight, and extend in the longitudinal direction of the said protective shell to be eliminated in the rearward direction, are meaningful, supporting measures in this connection. As an alternative to the above-described utilization of the dynamic pressure, it is also possible to use a gas generator, as it is commonly used as the triggering mechanism in the case of, e.g., nonlethal active components, to disintegrate the radially inner protective shell.

The loading of the active components by a disintegration process of the type described first can be reduced even further in an extremely simple manner. It needs only be ensured that the explosive force decreases from the outside to the inside in the individual explosive foil layers. This may be achieved by specifically reducing the thickness of the foil and/or the area of the foil in the direction mentioned. The same result is also obtained by the explosiveness or the rate of burn-off being reduced from one explosive foil layer to the next in the said radial direction.

The rate of burn-off and the explosiveness of the explosive foil arranged in layers alternating with supportive structure foil as well as the time intervals between the sequential igniting pulses, which time intervals can be set according to the present invention, are selected depending on the material selected for the supportive structure foil layers. The materials suitable for this include especially materials which have a low modulus of elasticity, i.e., which are flexible as thin foils, but offer high resistance to forces of pressure, tensile forces and shearing forces in the plane of the foil. They also include, e.g., light metal foils, such as those made of aluminum, paper, and some plastic films. In addition, so-called intelligent materials, which have a greater hardness and lower deformability under the abrupt action of stronger mechanical forces than under normal conditions, are of extremely great interest for the application described, because such materials meet the conflicting requirements in terms of high resistance of the projectile body to firing forces and the lowest possible risk of injury imaginable upon the impact of the fragments on persons in an especially favorable manner.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENTS

Figure 1:
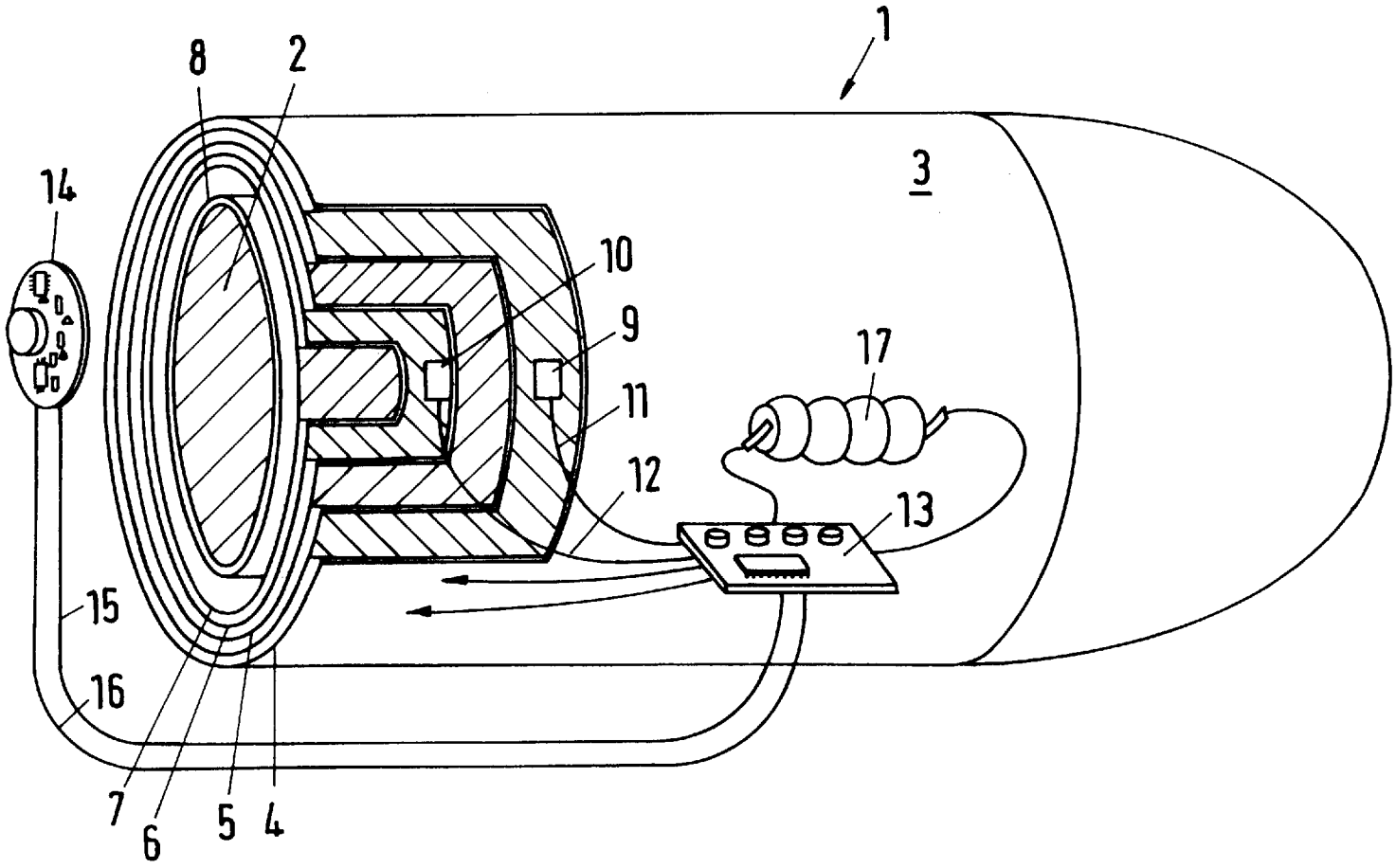
FIG. 1 is a perspective partially cut away view of a projectile according to the invention with the shell cut open.

FIG. 1 shows a projectile 1 with a mounting space 2, which is intended, e.g., to accommodate nonlethal active components. The said mounting space 2 is delimited by a projectile shell 3 of layered design. Between a radially outer layer 4 made of supportive foil material and a radially inner protective shell 8, made, e.g., of the same structure foil, the projectile shell 3 has two layers 5 and 7 of explosive foil. The two layers 5 and 7 of explosive foil are separated from one another by another shell layer 6 made of supportive foil material. Of the explosive foils, that of the layer 5 has a higher explosiveness than that of layer 7. Their ignition is staggered in time such that the layer 5 is initiated first via an igniter 9, and the layer 7 is initiated via an igniter 10 only thereafter, after a predetermined time period. To ensure that this happens, leads 11 and 12 lead from the igniters 9 and 10, respectively, to an igniting means 13 with sequential igniting pulses, which in turn is in functional connection with a receiver 14 via lines 15, 16. Its energy supply is designated by 17.

Figure 2:
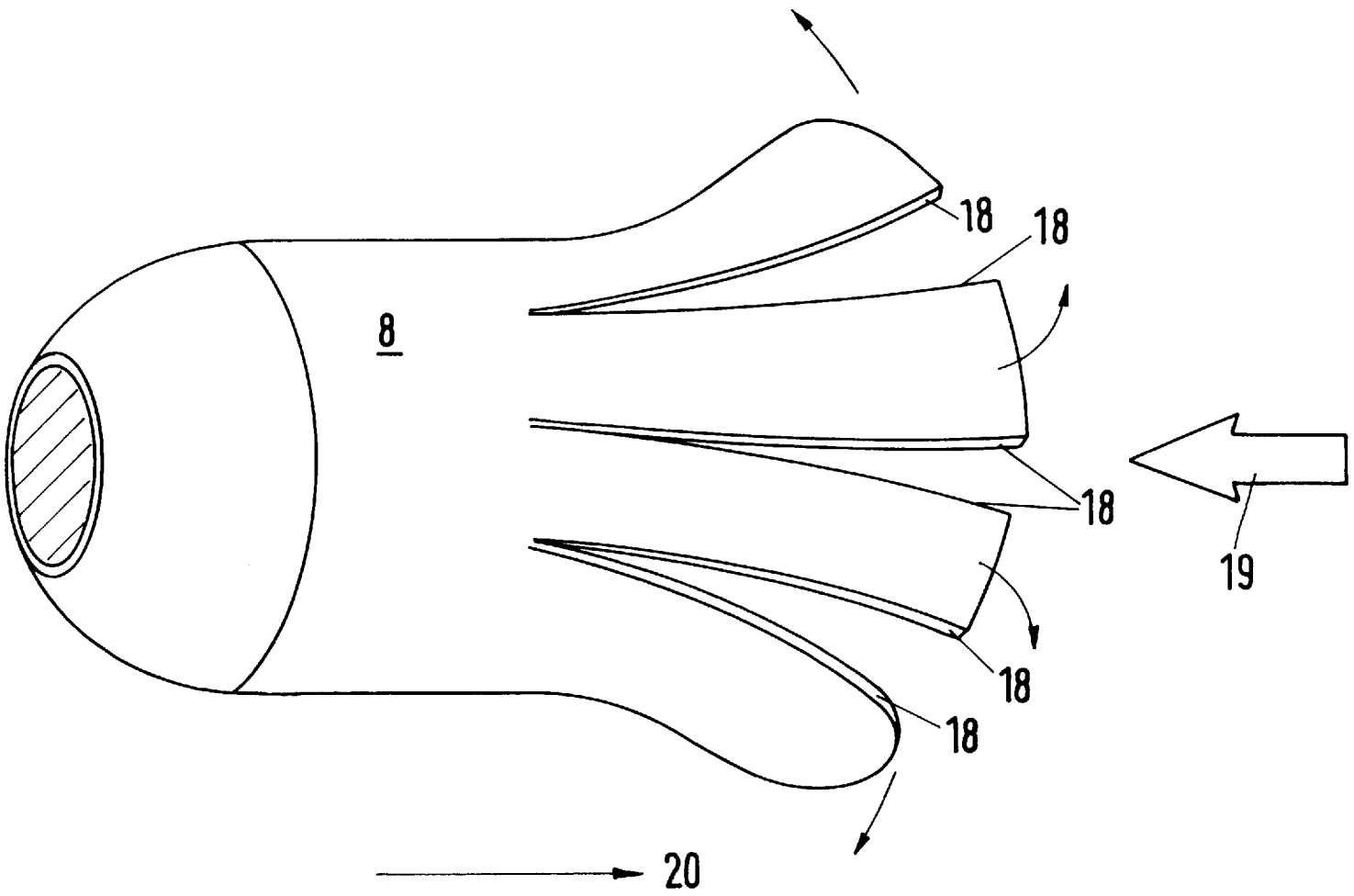
FIG. 2 is a detailed view showing the shell area of the projectile according to FIG. 1.

FIG. 2 shows how the protective shell 8 is eliminated subsequent to the pyrotechnic disintegration of the shell layers 4 and 6 consisting of structure foil by the shell layers 5 and 7 consisting of explosive foil, whose initiation is staggered in time. This happens by way of separation of predetermined breaking points 18 by means of the dynamic pressure beginning to act in the direction of arrow 19. The predetermined breaking points 18 begin from the end of the protective shell 8 which is the front end when viewed in the direction of flight 20. Beginning from there, they extend in the rearward direction in the longitudinal direction of the shell.

While a specific embodiment of the invention has been shown and described in detail to illustrate the application of the principles of the invention, it will be understood that the invention may be embodied otherwise without departing from such principles.

What is claimed is:

1. A now lethal projectile comprising:

a radially outer shell layer made of supportive foil material;

another shell layer made of supportive foil material adjacent said outer shell layer;

a radially inner protective shell surrounding a nonlethal active component;

pyrotechnic means for disintegrating each of said radially outer shell layer and said another shell layer successively, said pyrotechnic means including a first layer of explosive foil disposed between said radially outer shell layer and said another shell layer and a second layer of explosive foil disposed between said another shell layer and said radially inner protective shell, said pyrotechnic means including sequential igniting means for igniting said two layers made of explosive foil sequentially from the outside to the inside to successively shed said radially outer shell layer and said another shell layer.

2. The projectile in accordance with claim 1, wherein said radially outer shell layer and said another shell layer being formed of a foil selected from the group of materials consisting of aluminum, paper and plastic film.

3. The projectile in accordance with claim 1, wherein said radially outer shell layer and said another shell layer is formed of aluminum.

4. The projectile in accordance with claim 1, wherein said radially outer shell layer and said another shell layer is formed of one of paper and plastic.

5. The projectile in accordance with claim 1, wherein said radially inner projectile shell consists of a supportive foil material.

6. The projectile in accordance with claim 1, wherein said radially inner protective shell includes aerodynamic force disintegration means for disintegration by aerodynamic forces.

7. The projectile in accordance with claim 1, wherein said radially inner protective shell is provided with predetermined breaking regions, said breaking regions extend in a longitudinal direction from an end of the shell that is frontmost in a direction of flight.

8. The projectile in accordance with claim 1, wherein said layers made of explosive foil have explosiveness which decreases in a radial direction wherein an outer one of said layers made of explosive foil has an explosiveness greater than an inner one of said layers made of explosive foil.

9. The projectile in accordance with claim 1, wherein said pyrotechnic means includes an arrangement for remote or interval ignition associated with said projectile shell for the sequential ignition of said layers made of explosive foil.

10. The projectile in accordance with claim 9, wherein said pyrotechnic means includes settable time interval means for setting time intervals between sequential igniting pulses.

11. A nonlethal projectile, comprising:

a disintegratable shell including radially outer shell layers made of supportive foil material and a radially inner protective shell and pyrotechnic means for disintegrating the disintegratable shell including two shell layers made of explosive foil, each alternating with one of said layers made of supportive foil material, said pyrotechnic means including sequential igniting means for igniting said two layers made of explosive foil sequentially from the outside to the inside; and a nonlethal active component disposed in a mounting space defined by said protective shell, radially inwardly of said radially inner protective shell.

12. The projectile in accordance with claim 11, wherein said layer-forming supportive foil material comprises at least one of a metal, paper and plastic.

13. The projectile in accordance with claim 12, wherein said metal is aluminum.

14. The projectile in accordance with claim 11, wherein said radially inner projectile shell also consists of a supportive foil material.

15. The projectile in accordance with claim 11, wherein said radially inner protective shell includes aerodynamic force disintegration means for disintegration by aerodynamic forces.

16. The projectile in accordance with claim 15, wherein said aerodynamic force disintegration means includes predetermined breaking regions, said predetermined breaking regions extend in a longitudinal direction and originate from an end of the shell that is the front end when viewed in the direction of flight.

17. The projectile in accordance with claim 11, wherein said shell layers made of explosive foil have explosiveness which decreases in a radial direction wherein an outer one of said shell layers made of explosive foil has an explosiveness greater than an inner one of said shell layers made of explosive foil.

18. The projectile in accordance with claim 11, wherein said pyrotechnic means includes an arrangement for remote or interval ignition associated with said projectile shell for the sequential ignition of the said layers made of explosive foil.

19. The projectile in accordance with claim 18, wherein said pyrotechnic means includes settable time interval means for setting time intervals between sequential igniting pulses.

20. A process for delivering a nonlethal active component in a mounting space of a nonlethal projectile, comprising the steps of:

providing a radially inner protective shell around said nonlethal active component;

providing a disintegratable shell around said protective shell including a radially outer shell layer made of supportive foil material, another shell layer made of supportive foil material adjacent said radially outer shell layer and pyrotechnic means for disintegrating each of said radially outer shell layer and said another shell layer successively, said pyrotechnic means including a first layer of explosive foil disposed between said radially outer shell layer and said another shell layer and a second layer of explosive foil disposed between said another shell layer and said radially inner protective shell;

sequentially igniting said two layers made of explosive foil to successively shed said radially outer shell layer and subsequently said another shell layer.

* * * * *